US005107784A

United States Patent [19]

Lacy

[11] Patent Number: 5,107,784

[45] Date of Patent: Apr. 28, 1992

[54] DOCKING SYSTEM FOR BOATS

[76] Inventor: Franklin R. Lacy, 12819 SE. 38th Ave., Suite 57, Bellevue, Wash. 98006

[21] Appl. No.: 657,069

[22] Filed: Feb. 19, 1991

[51] Int. Cl.[5] ..... B63B 21/24

[52] U.S. Cl. ..... 114/263; 114/293

[58] Field of Search ..... 114/230, 263, 264, 357, 114/293, 294; 405/26, 27, 212, 219

[56] References Cited

U.S. PATENT DOCUMENTS

| | | | |
|---|---|---|---|
| 3,425,069 | 2/1969 | Christians | 441/3 |
| 3,695,207 | 10/1972 | Atlas | 114/230 |
| 3,775,787 | 12/1973 | Rager | 114/230 |
| 3,977,344 | 8/1976 | Holford | 114/263 |
| 4,342,277 | 8/1982 | Sluys | 114/263 |

FOREIGN PATENT DOCUMENTS

| | | | |
|---|---|---|---|
| 128090 | 7/1985 | Japan | 114/293 |

*Primary Examiner*—Jesus D. Sotelo
*Assistant Examiner*—Stephen P. Avila
*Attorney, Agent, or Firm*—Jensen & Pentigam

[57] ABSTRACT

The docking system (10) includes a plurality of docking members (16, 17, 18) connected together end to end. Each docking member (16, 17, 18) is anchored to the bottom surface (47) of the body of water by means of a combination of fixed anchor members (42, 44), connecting cables (46, 52) and a suspended anchor member (50) which is suspended in the water between the respective docking members (16, 17, 18) and the bottom surface (47). At the water end of the plurality of docking members (16, 17, 18) is positioned crosswise a breakwater member (19) which is substantially longer than the width of the docking members (16, 17, 18). The breakwater member (19) has an anchor system comprising a fixed anchor member (64), an anchor cable (68) and a suspended anchor member (70).

17 Claims, 3 Drawing Sheets

DOCKING SYSTEM FOR BOATS

TECHNICAL FIELD

This invention relates generally to the art of docking systems for boats and more particularly concerns a floating dock system which is anchored to the surface at the bottom of the body of water.

BACKGROUND OF THE INVENTION

Docking systems of various configurations are used as a means of transport for passengers, goods and the like between a boat and land, as well as for moorage for boats. Large docking systems, such as used in commercial harbors, which service large boats and/or a large number of smaller boats, typically comprise large, if not massive structures which are typically rigidly anchored into the earth surface at the bottom of the body of water, hereinafter referred to as the bottom surface. A typical arrangement includes a number of wooden, metal or cement pilings which are driven deep into the bottom surface and which support a walkway or the like for people or vehicles at some point above the water, forming what is generally referred to as a pier. Even most of the smaller docks, which service small private boats, typically include a walkway portion which is supported by rigid members which extend either to the bottom surface or some distance into the bottom surface.

The disadvantage of such traditional docking structures with rigid pilings is that they are typically quite expensive to construct and are susceptible to breakage. One example is the docking systems which are used to receive large vessels such as ferries or the like. If the control systems for the boat fail or human error occurs during docking, significant damage to the docking system will occur, which typically will include the pilings being broken off at or near the bottom surface. Repair of such damage takes a substantial amount of time and is quite expensive, since it requires the removal of the damaged pilings and the installation of new ones.

In addition to damage caused by the action of boats against the dock, docking systems can be damaged by severe weather as well. Again, if significant damage to the pilings occurs, the damaged pilings must be removed and new pilings installed.

As an alternative to the above-described docking systems, which due to their inherent rigidity, do provide convenient and reliable access between the boat and land, there are what are known as floating docks, which generally are supported by skid-type pilings and which thus move to some extent with the action of the water. Such docking systems are secured to the land by various conventional means. However, such docks are typically quite unstable, and are subject to a wide range of movement, depending upon the action of the boats using the dock. Also, floating docks, even with the skid pilings, are susceptible to significant damage from a boat, which is out of control or unable to stop. In addition, floating docks are quite susceptible to damage due to adverse weather conditions. They can be moved about by wind and wave action, and may cause damage to adjacent structures as well as themselves being susceptible to damage.

Hence, a reliable docking system is needed which is strong and capable of absorbing reasonably large forces created by docking boats as well as severe weather conditions, without being so rigid that excessive damage is caused when it is struck with very strong force.

DISCLOSURE OF THE INVENTION

Accordingly, the invention is a docking system which includes at least one floating dock member, an anchoring system which includes two fixed anchor members on the bottom of the body of water beneath the dock member, and a suspended anchor member, and first and second anchor lines. The first anchor line extends between one fixed anchor member, a first fixed connecting element on the dock member and the suspended anchor member. The second anchor line extends between the other fixed anchor member, a second fixed connecting element on the dock member and the suspended anchor member, wherein the first and second anchor lines are arranged such that the suspended anchor member is suspended in the water between the dock member and the bottom surface and wherein the anchor lines are free to move, respectively, about the fixed connecting elements on the dock member, such that the lengths of the anchor lines between the fixed anchor members and the fixed connecting elements on the dock member will vary in accordance with the position of the dock member relative to said fixed anchor members, and such that dock member will tend to stay in place.

BEST MODE FOR CARRYING OUT THE INVENTION

Figure 1:
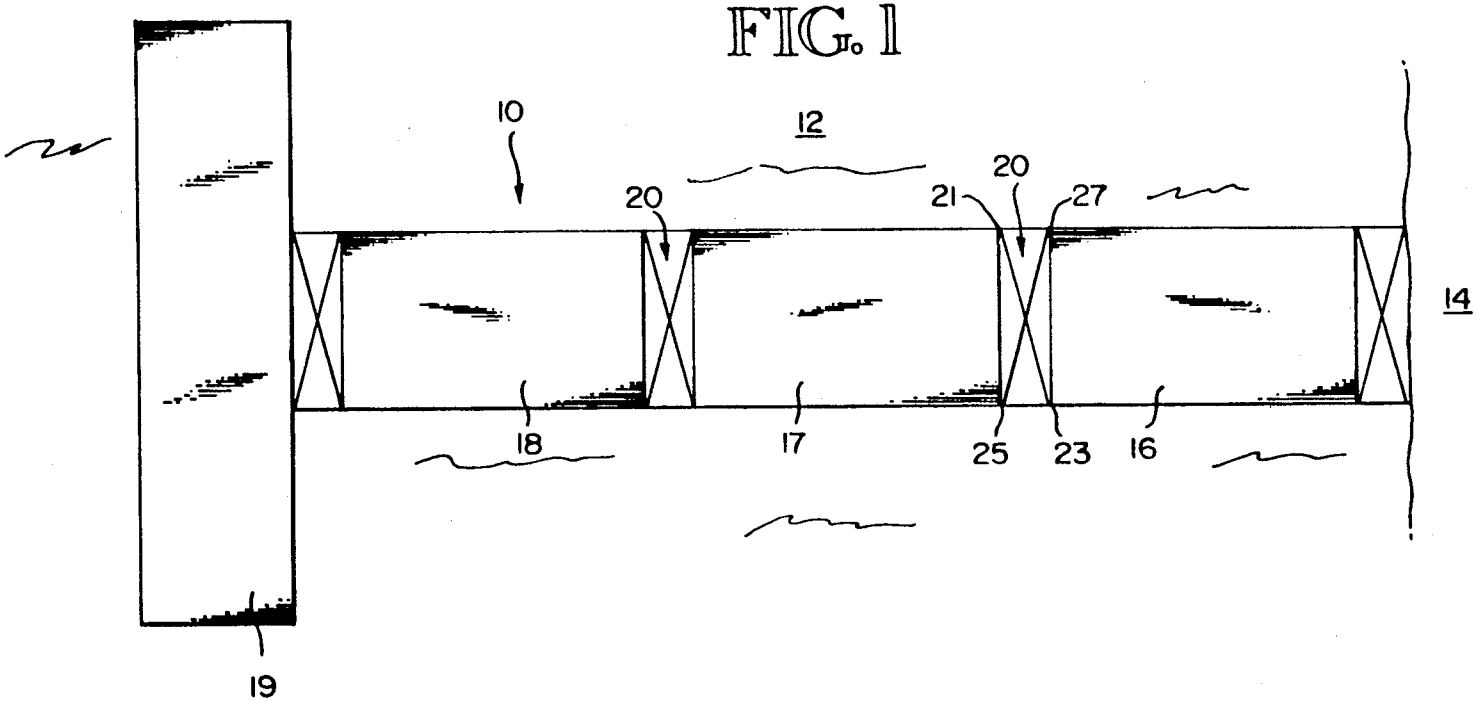
FIG. 1 is a plan view of the docking system of the present invention.
Figure 2:
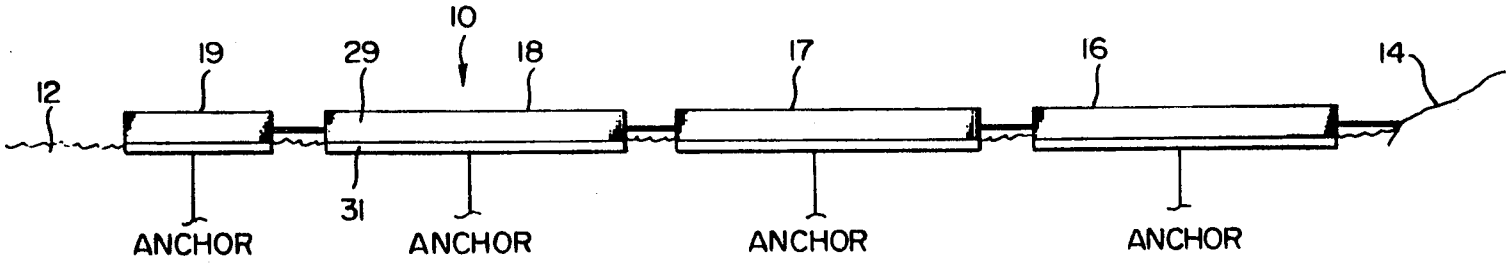
FIG. 2 is an elevational view of the docking system of FIG. 1.

FIGS. 1 and 2 show a combination of elements which comprise one embodiment of the docking system of the present invention. In FIG. 2, an anchoring system portion of the overall docking system is shown in a representative fashion, and is more clearly disclosed in FIGS. 3 and 4.

The docking system, shown generally at 10, comprises a plurality of elements which float on a body of water 12, such as a lake or bay, for instance, extending away from a land mass shown at 14. In the embodiment shown, the docking system 10 includes three identical docking members 16–18 which are connected together endwise, with a breakwater member 19 being positioned at the water end of the last one 18 of the three docking members. It should be understood, however, that the particular combination is illustrative only and that the invention is not necessarily limited to three docking members and a breakwater member.

In the embodiment shown, each docking member is 19 feet long and 8 feet wide, while the breakwater is 50 feet long and 10 feet wide. These sizes, of course, are illustrative only and may be varied significantly. The docking members 16–18 are lashed together end to end by cables or straps 20 arranged in an X pattern. In the X pattern arrangement, as an example, one rear corner 21 of docking member 17 is connected to a diagonally opposing front corner 23 of an adjacent docking element 16 while the other rear corner 25 of the one docking member 17 is connected to the other front corner 27 of the adjacent docking member 16. In addition, to further increase the strength of the connection between docking members 16 and 17, the two rear corners 21, 25 of docking member 17 are connected, respectively to the directly opposing front corners 27, 23 of docking member 16.

Typically, in the embodiment shown, the space between adjacent docking members will be approximately six feet, but this could be varied significantly. A walkway of boards or metal typically will extend the entire distance encompassed by the plurality of docking members, connected in a flexible manner to the top surface of the docking members, to permit convenient access between the land and a boat which is moored adjacent to the docking members.

The individual docking members and the breakwater are constructed so that they float, using closed cell foam with a layer of reinforced concrete. In the manufacture of the docking members, a thin layer of fiberglass or PVC material is sprayed and/or laid onto a mold which is the mirror image of the configuration (concave) of the docking member. The fiberglass/PVC layer forms a surrounding "envelope" for the completed docking member. In the embodiment shown, the docking member dimensions are 19 feet long by 8 feet wide by 3 feet high. The mold has a size and configuration to produce such a docking member. After the fiberglass layer is sprayed onto the mold, a polyurethane closed cell foam is poured into the mold. At each corner, or along opposed longitudinal sides or in other selected locations, is positioned a wood member so that when the docking member is removed from the mold, the wood members appear at the upper corners or other selected locations on the docking member.

The fiberglass/PVC layer 28 is relatively thin. The polyurethane foam layer 29 will typically be approximately 28 inches high. On top of the polyurethane foam layer 29 is poured a layer of concrete 31 with reinforcing rebar or other reinforcing elements positioned therethrough. This arrangement provides structural strength and a lowered center of gravity for the docking members. The exposed portion of the concrete layer is then covered with a layer of fiberglass, resulting in the docking member being encased in a layer of fiberglass/PVC. When the material has thoroughly dried, the docking member is removed from the mold. The finished docking member in the embodiment shown weighs approximately 11,000 pounds.

Figure 3:
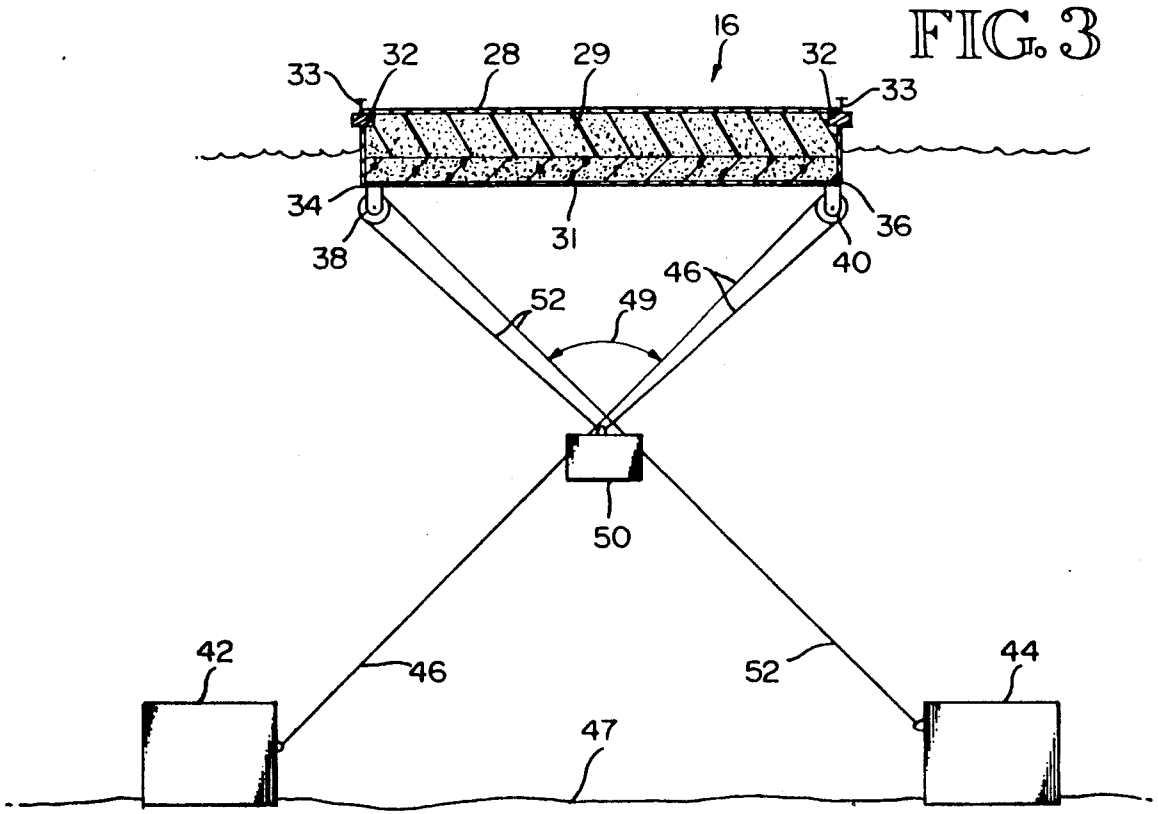
FIG. 3 is an elevational view of one docking member of the docking system of FIG. 1 and the anchor system associated therewith.

The member is positioned in the water with the concrete layer 31 down, as shown in FIG. 3. The wood elements 32 at the corners or other locations of the docking member are above the surface of the water and it is to these elements that docking cleats 33 or similar elements are secured by means of bolts or the like. The docking cleats 33 permit the direct securing of boats to the docking members through the use of conventional docking lines or the like. In the embodiment shown, breakwater 19 is made in a similar manner. One of the key aspects of the docking system of the present invention is the anchoring system therefor, which permits the docking members and the breakwater to absorb a large amount of force, either by virtue of hard contact by a boat or the like or by severe weather, without sustaining significant damage. The anchoring system also permits the docking members to rise and fall with the tide.

The anchoring system is shown in FIG. 3. The docking member (16 is exemplary) is shown in end view, displaying its successive layers of reinforced concrete and polyurethane foam and the wood corner and side elements with their protruding cleats. In use of the docking system of the present invention, a boat will be positioned/moored adjacent the docking member 16. Extending from each of the lower end corners 34 and 36 of the docking member 16 are pulleys 38 and 40. Two large, heavy, fixed anchor members 42 and 44 are positioned on the bottom surface 47. In the embodiment shown, anchor members 42 and 44 are blocks of cement weighing two tons each. However, the fixed anchor members could be steel beams or screw anchors driven into the bottom surface as well. The fixed anchor members 42 and 44 are positioned outboard of the respective end corners 34 and 36 of docking member 16; in the embodiment shown, usually greater than 100 feet outboard thereof.

A first cable 46 extends from one of the fixed anchor members 42 upwardly through and around pulley 40 which is on the lower end corner 36 diagonally removed from fixed anchor member 42. A second cable 52 is connected from the other fixed anchor member 44 upwardly and around the other pulley 38 which is located on the other lower end corner 34 of docking member 16, diagonally removed from fixed anchor member 44. The two cables 46 and 52 thus form a large X, crossing such that there is in the embodiment shown an angle of approximately 90° between cables 46 and 52. An angle within the range of 75°–150° will typically provide good results. A shallow angle would permit too much side-to-side movement of the docking member. The angle is determined by the position of fixed anchor members 42 and 44 relative to the docking member and the position of suspended anchor member 50 relative to the docking member and the bottom surface. In the embodiment shown, cables 46 and 52 cross approximately half-way between end corners 34 and 36. The particular cable relationship shown, however, is only illustrative of one embodiment.

The ends of the cables 46 and 52 remote from the fixed anchor members 42 and 44 are connected to a suspended anchor member 50. In the embodiment shown, the cables 46 and 52 are connected to approximately the same spot on suspended anchor member 50 such that it is suspended in the water approximately half way between docking member 16 and bottom surface 47 and halfway between end corners 34 and 36 of docking member 16. In the embodiment shown, with the fixed anchor members each weighing approximately two tons, the suspended anchor member 50 weighs approximately one ton. While the actual weight of the various anchor members will vary from system to system, it is important that the suspended anchor member 50 weigh significantly less than the fixed anchor members and that the suspended anchor member be actually suspended in the water medium. The fixed anchor members typically, but not necessarily, weigh considerably more than the docking member.

Figure 5:
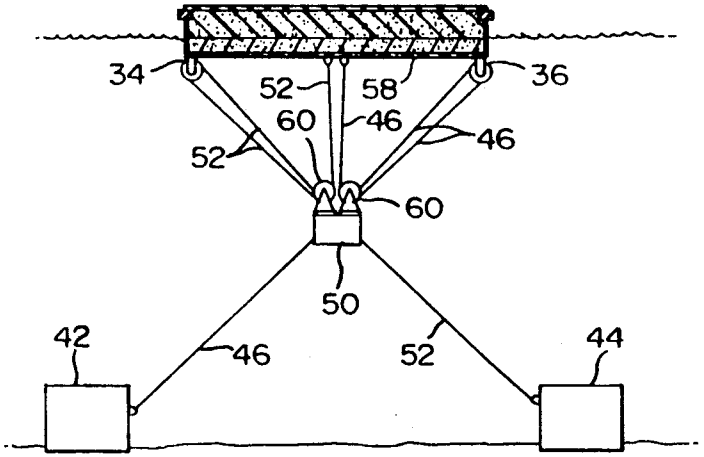
FIG. 5 is an elevational view of an alternative embodiment of the anchor system of FIG. 3.

FIG. 5 shows an alternative cable arrangement for the suspended anchor member 50. The system of FIG. 5 can be used to accommodate large differences between high and low tides. In this embodiment, pulleys 60 are secured to the upper surface of suspended anchor member 50. The cables 46 and 52 from opposing end corners 34 and 36 extend around their respective associated pulleys 60 and then up to the bottom surface 58 of the docking member, where they are secured. Typically, they will be secured at a point directly above suspended anchor member 50, but they could be secured at spaced points along the bottom surface of the docking member, even out to the vicinity of the pulleys through which they extend, respectively, at the bottom surface of the docking member.

The above-described anchor arrangement such as shown in FIG. 3 or FIG. 5 has been found to be quite effective, since a force exerted against one side of the docking member 16 will tend initially to result in a movement of the docking member in the direction of the applied force. This will tend to shorten the distance between the suspended anchor member 50 and the opposing corner of the docking member 16, which in turn will create a countervailing action by virtue of the crossed cables 46 and 52, the fixed anchor members 42 and 44 and the suspended anchor member 50. Thus, the docking member 16 will move in the direction of the force only a relatively small distance before it begins to move back in the opposite direction. If the force is too great, one or the other of the fixed anchor members will begin to drag. However, the fixed anchor members can be moved back to their original position quickly and inexpensively and the docking member thus can be back in full service in a very short period of time.

Typically, the anchoring system shown in FIG. 3 will be used at each longitudinal end of a given docking member. The anchoring system could, however, be also used at one or more longitudinal midpoints along the length of the docking member, depending upon the size of the docking member and the particular application in which the docking member is used.

Figure 4:
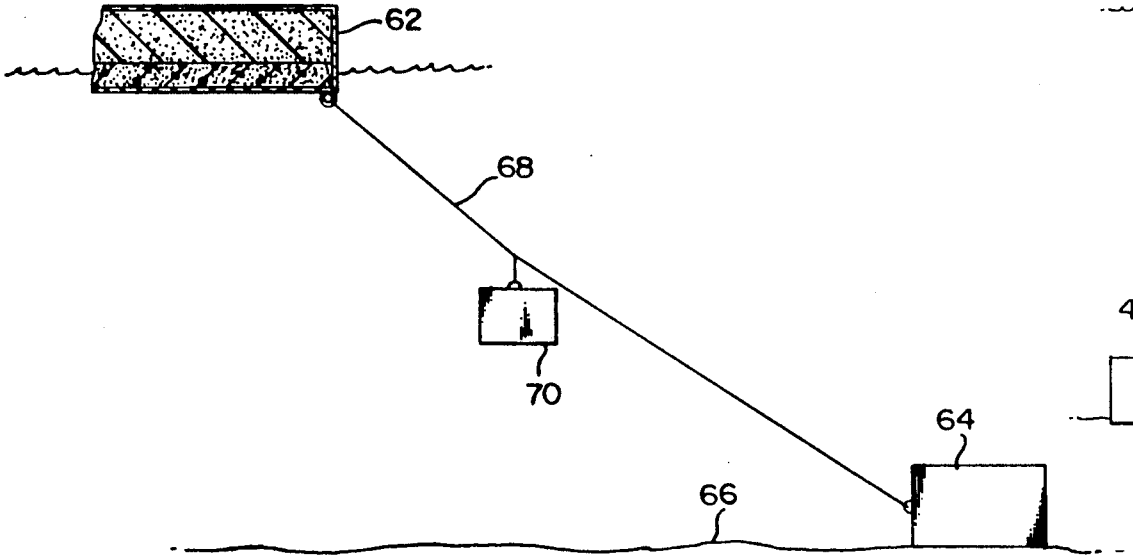
FIG. 4 is an elevational view of a breakwater portion of the docking system and the anchor system associated therewith.

FIG. 4 shows a different anchoring system used for breakwater 19. The anchoring system for the breakwater 19 is different since its primary function in the total docking system of the present invention is to act as a breakwater for the docking members and typically will not itself be used to moor boats.

In the anchoring system of FIG. 4, a large fixed anchor member 64 is positioned on a bottom surface 66. Anchor member 64 could be in the form of a large concrete block or it could be metal pilings or screw anchors driven into the bottom surface 66 or other similar system. As one example, anchor member 64 could weigh approximately two tons. Extending between fixed anchor member 64 and one end 62 of the breakwater member 19 is an anchor cable 68. Secured to and extending downwardly from anchor cable 68 approximately at its midpoint is a suspended anchor member 70. Again, suspended anchor member 70 will typically weigh significantly less than the fixed anchor member 64. In the embodiment shown, suspended anchor member 70 weighs approximately one ton. The weights of the fixed anchor member and the suspended anchor member are selected so as to be cumulatively significantly greater than the force of the breakwater buoyancy. Hence, the breakwater will remain steady during any wave action, such that it will tend to submerge briefly beneath heavy waves.

The anchor system shown in FIG. 4 tends to significantly limit the range of possible movement of the breakwater member. Typically, the anchor system shown in FIG. 4 will be secured to the opposing ends of the breakwater member.

Thus, a docking system has been shown and described which in one embodiment comprises at least one floating dock member and includes an anchoring system for the docking member which is capable of absorbing a substantial force applied to the docking member without significant damage. If the force is great enough to drag the fixed anchor members, they can be readily moved back into proper position. The dock members can easily rise and fall with the tide. Several docking members may be connected end to end to form an extended dock, with the size of the dock depending upon the particular application. Relatively large size docks can be easily produced using the principles of the present invention. At the water end of the plurality of docking members is located a breakwater member which also has its own anchoring system. The breakwater is positioned crosswise at the end of the set of docking members, and is typically substantially longer than the width of the docking members. Such a combination results in a docking system which is relatively inexpensive to manufacture, easy to install, is quite durable relative to forces exerted against it, and perhaps most importantly, is easy to repair should the anchoring system be damaged.

Although the invention has been described in the context of a docking system for boats, it is also applicable to other floating platform applications, such as oil rigs, defense platforms, etc.

Although a preferred embodiment of the invention has been disclosed herein for illustration, it should be understood that various changes, modifications and substitutions may be incorporated in such embodiment without departing from the spirit of the invention as defined by the claims that follow:

What is claimed is:

1. A docking system, comprising:

at least one floating dock member;

an anchoring system which includes at least two fixed anchor members on the bottom of the body of water beneath the dock member, and a suspended anchor member, wherein the fixed anchor members are located outboard of the dock member a substantial distance relative to the size of the dock member;

a first anchor line extending between one fixed anchor member, a first fixed connecting element on the dock member and the suspended anchor member; and a second anchor line extending between the other fixed anchor member, a second fixed connecting element on the dock member, and the suspended anchor member, wherein the first and second anchor lines are arranged such that the suspended anchor member is suspended in the water between the dock member and the bottom of the body of water and wherein the anchor lines are free to move, respectively, about the fixed connecting elements on the dock member, such that the lengths of the anchor lines between the fixed anchor members and the fixed connecting elements on the dock member will vary in accordance with the position of the dock member relative to said fixed anchor members, and such that the dock members will tend to remain in place.

2. A system of claim 1, wherein the two fixed anchor members each weigh substantially more than the dock member and wherein the suspended anchor member weighs less than the fixed anchor members.

3. A system of claim 1, wherein the connecting elements are located on the lower surface of the dock member in the vicinity of opposing sides thereof, and wherein the fixed anchor members, respectively, are located outboard of the dock member from the sides thereof which are opposite the sides to which the fixed connecting elements associated with the respective fixed anchor members are located, such that the first and second anchor lines cross each other beneath the dock member.

4. A system of claim 3, wherein the two fixed anchor members weigh approximately the same and wherein the suspended anchor member weighs approximately one half of the fixed anchor members.

5. A system of claim 3, wherein the connecting elements comprise pulleys.

6. A system of claim 5, wherein the length of the first and second anchor lines cross beneath the dock member, at an angle within the range of 75°-130°.

7. A system of claim 6, wherein anchoring systems are located at opposing ends of the dock member and wherein the fixed connecting elements on the dock member are located in the vicinity of each lower corner thereof.

8. A system of claim 1, wherein the dock member comprises at least two layers, including a first, lower layer comprising reinforced concrete and a second, upper layer comprising a closed cell polyurethane foam, wherein the second layer is substantially thicker than the first layer.

9. A system of claim 8, wherein the second layer includes a plurality of mounting elements therein, from which extend cleats adapted to receive boat lines for the mooring of boats.

10. A system of claim 8, wherein the dock member is encased with a layer of fiberglass.

11. A system of claim 8, wherein the dock member is encased with a layer of PVC material.

12. A system of claim 1, wherein the first and second anchor lines are fixedly secured to the suspended anchor member.

13. A system of claim 1, including third and fourth connecting elements, positioned on said suspended anchor member, and wherein the first and second anchor lines extend through the third and fourth connecting elements to the dock member.

14. A system of claim 13, wherein the third and fourth connecting elements are pulleys and the first and second anchor lines are free to move thereabout.

15. A system of claim 1, including a breakwater member positioned at a water end of the docking member, the breakwater member being substantially longer than the width of the docking member and positioned at right angles to the docking member and further including a breakwater anchor element which includes another fixed anchor member which is positioned on the bottom surface of the body of water, an anchor line connecting said another fixed anchor member to the breakwater member and another suspended anchor member attached to the anchor line at a point such that it is suspended between the breakwater member and the bottom.

16. A system of claim 15, including a plurality of docking members, wherein each docking member has an anchoring system and wherein the plurality of docking members are connected end-to-end in such a manner that each docking member can move somewhat independently of the other docking members.

17. A floating platform system, comprising:

at least one floating platform member;

an anchoring system for the platform member which includes at least two fixed anchor members on the bottom of the body of water beneath the platform member, and a suspended anchor member, wherein the fixed anchor members are located outboard of the platform member a substantial distance relative to the size of the platform member;

a first anchor line extending between one fixed anchor member, a first fixed connecting element on the platform member and the suspended anchor member; and a second anchor line extending between the other fixed anchor member, a second fixed connecting element on the platform member, and the suspended anchor member, wherein the first and second anchor lines are arranged such that the suspended anchor member is suspended in the water between the platform member and the bottom of the body of water and wherein the anchor lines are free to move, respectively, about the fixed connecting elements on the platform member, such that the lengths of the anchor lines between the fixed anchor members and the fixed connecting elements on the platform member will vary in accordance with the position of the platform member relative to said fixed anchor members and such that the platform member will tend to remain in place.

* * * * *